United States Patent [19]

Cox et al.

[11] 4,321,183

[45] Mar. 23, 1982

[54] SOLID GOLF BALL CENTER WITH BLOCK BUTADIENE-STYRENE POLYMERS

[75] Inventors: Alvon R. Cox, Ashland; Thomas A. Molyneaux, Englewood, both of Ohio

[73] Assignee: Abbott Laboratories, North Chicago, Ill.

[21] Appl. No.: 155,254

[22] Filed: Aug. 8, 1980

Related U.S. Application Data

[63] Continuation-in-part of Ser. No. 945,950, Sep. 26, 1978, abandoned.

[51] Int. Cl.[3] ..... C08L 53/02

[52] U.S. Cl. ..... 524/423; 273/230; 525/901; 524/572

[58] Field of Search ..... 260/42.46, 42.47, 33.6 AQ; 525/901; 273/218, 230

[56] References Cited

U.S. PATENT DOCUMENTS

| | | | |
|---|---|---|---|
| 3,373,123 | 3/1968 | Brice | 260/42.47 |
| 3,534,965 | 10/1970 | Harrison | 273/218 |
| 3,562,204 | 2/1971 | Van Breen | 260/42.47 |
| 4,048,254 | 9/1977 | Hillier et al. | 525/71 |
| 4,048,255 | 9/1977 | Hillier et al. | 525/71 |
| 4,076,255 | 2/1978 | Moore et al. | 260/42.47 |

FOREIGN PATENT DOCUMENTS

| | | | |
|---|---|---|---|
| 2146176 | 4/1973 | Fed. Rep. of Germany | 260/42.47 |

*Primary Examiner*—Wilbert J. Briggs, Sr.

*Attorney, Agent, or Firm*—Robert L. Niblack; Neil E. Hamilton

[57] ABSTRACT

Radial block copolymers of the butadiene-styrene type are utilized in an uncured state to form a solid golf ball center which has high rebound characteristics as well as various durometers. The golf ball centers containing the radial block copolymers can be formulated to obtain the specific properties desired by a particular manufacturer and can be manufactured at a lower cost than those presently available.

8 Claims, 1 Drawing Figure

SOLID GOLF BALL CENTER WITH BLOCK BUTADIENE-STYRENE POLYMERS

CROSS REFERENCE TO RELATED APPLICATIONS

This is a continuation-in-part of U.S. patent application Ser. No. 945,950, filed Sept. 26, 1978, now abandoned.

BACKGROUND OF THE INVENTION

This invention relates to thermoplastic polymers which are useful in molding centers for golf balls. More particularly, it relates to the use of thermoplastic polymers composed of block radial polymers of the dienearyl substituted olefin butadiene-styrene type which contains a major portion of a filler material as well as an extender to form a golf ball center having high rebound characteristics as well as offering versatility in meeting manufacturing specifications.

Currently golf balls are produced in the following forms:

1. A one component solid construction composed of a homogeneous mass consisting of polybutadiene, monomers, fillers, antioxidants, curing agents, etc.

2. A two component golf ball comprising a cover composed of natural rubber (Balata) or plastic (Surlyn) including urethanes; and a core composed of a solid homogeneous mass similar to Item #1.

3. A three component golf ball composed of a cover composed of Balata rubber, plastic (Surlyn) or similar material; a winding composed of natural and/or synthetic rubber thread; and a core made from natural or synthetic polymers.

4. A four component golf ball having a cover as described in Items 2 and 3; a winding as described in Item 3; a core wall made from natural and/or synthetic rubber; and a liquid center composed of glycerin; polyethylene glycol, salt solutions, etc.

The golf ball center of the type concerned with in this invention is the Center or Core in Item 3.

Block copolymers of butadiene-styrene and styrene-butadiene-styrene type are described in U.S. Pat. No. 3,534,965 to produce a solid golf ball. The block copolymers are blended and cured to result in the solid golf ball. Styrene-butadiene copolymers are also vulcanized in a blend with a polytetrahydrofuran to form a molded golf ball in U.S. Pat. No. 3,373,123. In U.S. Pat. Nos. 4,048,254 and 4,048,255 blends of uncured radial block copolymers are described for use with a third polymeric material for use in making thermoplastic materials for pharmaceutical purposes. The prior art nowhere describes an uncured, butadiene-styrene radial block copolymer having a specific butadiene and styrene content in combination with a major portion of a filler material for use in the manufacture of a solid golf ball center. Neither does the prior art indicate that an uncured butadiene-styrene radial block copolymer can be employed in formulations for composing golf ball centers wherein the use of fillers and extenders can be freely incorporated to obtain centers having high rebound and various durometers.

It is an advantage of the present invention to provide a solid golf ball center composed of an uncured butadiene-styrene radial block copolymer. Other advantages are a solid golf ball center containing a major portion of filler material as well as extenders so as to permit versatility in achieving desired properties for a golf ball; a solid golf ball center which can be molded by various molding techniques including injection molding so as to afford rapid production as well as size and weight control; a solid golf ball composition which eliminates the need for curing and permits the reuse of trim and runner system material.

SUMMARY OF THE INVENTION

The foregoing advantages are accomplished and the shortcomings of the prior art are overcome by the present solid golf ball center which includes a noncross-linked butadiene-styrene radial block copolymer having a butadiene content in the range of about 50–85% by weight and a styrene content in the range of about 15–50% by weight. A major portion of the golf ball center includes a filler material with the noncross-linked butadiene-styrene radial block copolymer as well as an extender in the form of an oil. The radial block copolymer will have a molecular weight of at least 150,000 and can be as high as 300,000. In one embodiment of the invention, two radial block copolymers will be employed having different butadiene-styrene contents. In a preferred embodiment, the filler material will be present in an amount of about 60–80% by weight of the golf ball center and will not exceed 80%. The extender will be present in the range of about 5–20% by weight of total center composition. The center composition will be substantially free of curing agents or initiators. A better understanding of the solid golf ball center will be afforded by reference to the drawing wherein:

DESCRIPTION OF THE PREFERRED EMBODIMENT

Figure 1:
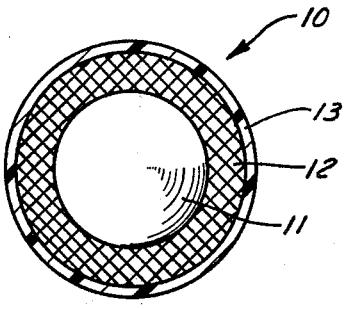
FIG. 1 is a view in partial cross-section showing the golf ball center or solid core in a three component golf ball.

The solid golf ball core or center concerned with in this invention is shown in FIG. 1 of the drawing in conjunction with a three component golf ball generally 10. The numeral 11 represents the solid core or center. A winding is represented by the numeral 12, and 13 is the cover. The winding and cover are standard materials as discussed at item 3 in the second paragraph of the specification.

The radial block copolymers utilized in the following Examples are readily available on the commercial market and are composed of 50–85% by weight of butadiene and 15–50% by weight of styrene. The radial block copolymers have a molecular weight ranging from 150,000 to 300,000 as measured by gel permeation chromatography and a specific gravity ranging from 0.92 to 0.95. The preferred radial block copolymers are sold under the tradename SOLPRENE and available from the Phillips Petroleum Company.

The invention is disclosed in further detail by means of the following Examples which are set forth for the purpose of illustrating the invention, but, in no way are to be construed as limiting the invention to the precise amounts, ingredients or conditions indicated.

EXAMPLE I

| Ingredients | Formula by Parts (phr*) |
|---|---|
| Radial Block Copolymer | 75 |

-continued

| Ingredients | Formula by Parts (phr*) |
|---|---|
| (80:20 Butadiene-Styrene) Radial Block Copolymer (70:30 Butadiene-Styrene) | 25 |
| Filler (Barium Sulfate) | 220 |
| Extender (Paraffinic Oil) | 25 |
| Antioxidant (Hindered Phenol) | 1.0 |
| | 346.0 |

*Parts/Hundred/Rubber Polymer

The barium sulfate and the antioxidant are placed in a Banbury-type internal mixer of suitable capacity. The mixing device is operated for 30 seconds after which the radial block copolymers are added and approximately one-third of the paraffinic oil. Mixing is subsequently effected until three minutes after which an additional one-third of the paraffinic oil is added and after four minutes the balance of the paraffinic oil is added. The mixing unit is operated for an additional minute to bring the total mixing time to five minutes. After this time, the entire ingredients are dumped from the mixer at a temperature of 100–125 degrees C. onto mill rolls which should have a temperature in the range of 75–85 C. for the stripping off of the material and its cooling. The cooled material can then be diced into a ⅛–3/16 inch cube for later injection molding. The golf ball centers are then injection molded by any suitable injection molding device and will have a weight in the range of about 15 grams to about 22 grams and a diameter of 1-1/32 inch. The solid core center will then be wound in a usual manner with natural and/or synthetic rubber thread and covered with a natural rubber (Balata), plastic (Surlyn) or similar material.

EXAMPLE II

| Ingredients | Formula by Parts (phr*) |
|---|---|
| Radial Block Copolymer (80:20 Butadiene-Styrene | 50 |
| Radial Block Copolymer (70:30 Butadiene-Styrene | 50 |
| Filler (Barium Sulfate) | 490 |
| Extender (Paraffinic Oil) | 100 |
| Antioxidant (Hindered Phenol) | 0.5 |
| | 690.5 |

*Parts/Hundred/Rubber Polymer

The radial block copolymers, the barium sulfate and the antioxidant are placed in a high speed intensive mixer. The added materials are mixed for approximately 30 seconds after which time the paraffinic oil is added with the blender being operated at 1200 rpm. 40–50 phr of oil should be added over approximately 40–60 seconds to add 40–50 phr of oil. The mixing is continued at 1500 rpm until the compound appears to be free flowing. After this period of time the mixer is operated at 2000 to 2500 rpm for an additional 30 seconds. After approximately 1½ minutes of blending, the mixed material is dumped into a ribbon blender and cooled to a temperature of 35 degrees (C). The cooled and mixed material can then be pelletized in the usual manner from an extruder for later injection molding and final fabrication of the golf ball as indicated in Example I.

The type of blending equipment utilized in the Examples will depend upon what physical form the radial block copolymer is in when supplied. For example, if it is in the form of a bale, a Banbury-type internal mixer would only be used with a cooling facility and take-off. In the instance where it would be supplied in the form of a crumb or pelleted a Banbury mixer could likewise be employed and also a high-speed, intensive dry blender such as a Welex, Littleford, Henschel or equivalent equipment with a ribbon blender for cooling. The Banbury mixer will accommodate all three forms and has the advantage that it will accommodate higher use of fillers and extenders without fear of separation of the ingredients from the polymer. In contrast, the dry blend mixing offers the advantage of faster mixing cycles; lower power consumption; elimination of the take-off mill of the Banbury mixer. The material can be processed directly from the dry blend into a plastic processing equipment such as an injection molding machine.

Table I indicates additional formulations of the radial block copolymers where only a single radial block copolymer is employed. These formulations as well as those in Table II will be compounded as indicated in Examples I and II. Table I also designates the percent of rebound and durometer for these various formulations. Similarly, Table II lists formulations for two radial block copolymers similar to Examples I and II. Table II illustrates the use of the block copolymers with different butadiene-styrene contents and in ratios in the range of 25–75:75–25 parts by weight.

It will be seen from the various formulations that the filler material as represented by barium sulfate composes a major portion of the weight of the golf ball center. The amount of this material can range from about 60% to about 80% by weight of the golf ball center, but should not exceed 80%. While barium sulfate (Barytes) is the preferred filler material the following filler materials could likewise be employed in the same weight range: calcium carbonate, aluminum silicate, fumed colloidal silica (Carbosil), silica, magnesium silicate, carbon black, calcined aluminum silicate, precipitated hydrated silica, zinc sulfide (Lithophone), magnesium carbonate, hydrated aluminum silicate, wet ground mica and silicon dioxide.

An extender in the form of a paraffinic oil is utilized in the various formulations. If desired, it can be eliminated. If utilized, the amount can range from about 5% to 20% by weight of the golf ball center. While a paraffinic type is preferred and preferably of the mineral-oil type, other oil-type extenders of the napthenic variety could likewise be utilized with the aromatic oils being the least desired. This is indicated by the data presented in Table III concerning rebound and durometer properties.

In Table IV, the variation in weights of the golf ball center is indicated in relation to the specific gravity required as well as the weight of the filler material. This Table indicates the versatility in obtaining the golf ball center with the desired weight.

From the information given in the Tables, it will be seen that the low styrene content and high butadiene content results in a golf ball center with high rebound capabilities. Those formulations which give high durometers indicate that the use of fillers and extenders can be freely employed to obtain the desired properties of a golf ball center. Specifically, Table III illustrates that the best golf ball centers for rebound are produced using the higher proportions of extenders with the paraffinic oil being preferred.

From the information presented in Tables I and II, it will be seen that a radial block copolymer having a molecular weight of 160,000 and a butadiene-styrene amount of 80, 20% respectively is preferred whether the copolymer is used alone or in combination with another radial block copolymer. It will be seen with reference to Table II that the preferred radial block copolymer mixtures of this invention have different molecular weights yet can have the same or different butadiene-styrene amounts. In two of the preferred formulations listed in Table II, it will be seen that one of the radial block copolymers has a molecular weight of 160,000 or 150,000 and the other has a molecular weight of 300,000.

It will thus be seen that through the present invention there is now provided a formulation for a golf ball center which allows for a large latitude in formulation as as to accomplish the specific performance specifications. The utilization of an uncured radial block copolymer without the use of curing agents or initiators also affords injection molding with faster rates in that no curing or time consuming cross linkage need take place. Also, any finished materials which do not meet specifications can be reused, which is not possible when using a cross-linked polymeric material. Additionally, the injection molding process with the butadiene-styrene thermoelastomers permits precise size and weight control which is not accomplished when utilizing compression molding.

The foregoing invention can now be practiced by those skilled in the art. Such skilled persons will know that the invention is not necessarily restricted to the particular embodiments presented herein. The scope of the invention is given meaning by the preceding description.

TABLE I

| Polymer Radial Block | Mol Wt × 1000 | Oil | % Styrene | % Butadiene | A | B | C | D | E | F | G | H |
|---|---|---|---|---|---|---|---|---|---|---|---|---|
| 1 | 160 | No | 20 | 80 | 100.0 | | | | | | | |
| 2 | 300 | Yes | 30 | 70 | | 100.0 | | | | | | |
| 3 | 300 | No | 15 | 85* | | | 100.0 | | | | | |
| 4 | 150 | No | 30 | 70 | | | | 100.0 | | | | |
| 5 | 300 | No | 30 | 70 | | | | | 100.0 | | | |
| 6 | 150 | No | 40 | 60 | | | | | | 100.0 | | |
| 7 | 250 | No | 40 | 60 | | | | | | | 100.0 | |
| 8 | 300 | Yes | 50 | 50 | | | | | | | | 100.0 |
| Filler | | | | | 170.0 | 170.0 | 170.0 | 170.0 | 170.0 | 170.0 | 170.0 | 170.0 |
| Antioxidant | | | | | .5 | .5 | .5 | .5 | .5 | .5 | .5 | .5 |
| | | | | | 270.5 | 270.5 | 270.5 | 270.5 | 270.5 | 270.5 | 270.5 | 270.5 |
| *85% Isoprene in place of Butadiene | | | | | | | | | | | | |
| % Rebound | | | | | 65 | 57 | 55 | 51 | 40 | 37 | 32 | 25 |
| Shore A Durometer | | | | | 80 | 70 | 65 | 95 | 100 | 100 | 100 | 90 |
| Specific Gravity (Actual) | | | | | 1.830 | 1.846 | 1.853 | 1.832 | 1.878 | 1.859 | 1.852 | 1.841 |

TABLE II

| Polymer Radial Block | Mol Wt × 1000 | Oil | % Styrene | % Butadiene | A | B | C | D | E | F | G | H | I |
|---|---|---|---|---|---|---|---|---|---|---|---|---|---|
| 1 | 160 | No | 20 | 80 | 50.0 | | 75.0 | 75.0 | 75.0 | 75.0 | 75.0 | | |
| 2 | 300 | Yes | 30 | 70 | 50.0 | 75.0 | | | | | | 75.0 | |
| 3 | 300 | No | 15 | 85* | | | | | | | | | |
| 4 | 150 | No | 30 | 70 | | 25.0 | 25.0 | | | | | | 75.0 |
| 5 | 300 | No | 30 | 70 | | | | 25.0 | | | | | 25.0 |
| 6 | 150 | No | 40 | 60 | | | | | | 25.0 | | 25.0 | |
| 7 | 250 | No | 40 | 60 | | | | | | | 25.0 | | |
| 8 | 300 | Yes | 50 | 50 | | | | | 25.0 | | | | |
| Filler | | | | | 170.0 | 170.0 | 170.0 | 170.0 | 170.0 | 170.0 | 170.0 | 170.0 | 170.0 |
| Antioxidant | | | | | .5 | .5 | .5 | .5 | .5 | .5 | .5 | .5 | .5 |
| | | | | | 270.5 | 270.5 | 270.5 | 270.5 | 270.5 | 270.5 | 270.5 | 270.5 | 270.5 |
| *85% Isoprene in place of Butadiene | | | | | | | | | | | | | |
| % Rebound | | | | | 66 | 65 | 66 | 65 | 65 | 63 | 60 | 56 | 53 |
| Shore A Durometer | | | | | 73 | 75 | 82 | 85 | 80 | 85 | 85 | 80 | 95 |
| Specific Gravity (Actual) | | | | | 1.823 | 1.842 | 1.853 | 1.831 | 1.774 | 1.833 | 1.820 | 1.838 | 1.843 |

TABLE III

| Polymer Radial Block | Mol Wt × 1000 | Oil | % Styrene | % Butadiene | Type | A | | | B | | | C | | |
|---|---|---|---|---|---|---|---|---|---|---|---|---|---|---|
| | 150 | No | 40 | 60 | | | | | | | | | | |
| Filler | | | | | | 100.0 | | | 100.0 | | | 100.0 | | |
| Antioxidant | | | | | | 170.0 | | | 170.0 | | | 170.0 | | |
| Extender | | | | | | .5 | | | .5 | | | .5 | | |
| Extender | | | | | Paraffinic | 25 | 50 | 75 | | | | | | |
| Extender | | | | | Paraffinic | | | | 25 | 50 | 75 | | | |
| Extender | | | | | Naphthenic | | | | | | | 25 | 50 | 75 |
| | | | | | Naphthenic | | | | | | | | | |

TABLE III-continued

| | | | | | | | | | | | | | |
|---|---|---|---|---|---|---|---|---|---|---|---|---|---|
| Extender | | | | | | Aromatic | | | | | | | |
| Extender | | | | | | Naphthenic | | | | | | | |
| | | | | | | | 295.5 | 320.5 | 345.5 | 295.5 | 320.5 | 345.5 | 295.5 | 320.5 | 345.5 |
| % Rebound | | | | | | | 40 | 55 | 65 | 40 | 53 | 64 | 35 | 50 | 60 |
| Shore A Durometer | | | | | | | 90 | 75 | 65 | 80 | 75 | 55 | 90 | 75 | 65 |
| | | | | | | | 1.717 | 1.615 | 1.506 | 1.708 | 1.600 | 1.464 | 1.670 | 1.606 | 1.464 |
| Polymer Radial Block | Mol WT × 1000 | Oil | % Styrene | % Butadiene | Type | | D | | | E | | | F | | |
| | 150 | No | 40 | 60 | | | 100.0 | | | 100.0 | | | 100.0 | | |
| Filler | | | | | | | 170.0 | | | 170.0 | | | 170.0 | | |
| Antioxidant | | | | | | | .5 | | | .5 | | | .5 | | |
| Extender | | | | | | Paraffinic | | | | | | | | | |
| Extender | | | | | | Paraffinic | | | | | | | | | |
| Extender | | | | | | Naphthenic | | | | | | | | | |
| Extender | | | | | | Naphthenic | 25 | 50 | 75 | | | | | | |
| Extender | | | | | | Aromatic | | | | 25 | 50 | 75 | | | |
| Extender | | | | | | Naphthenic | | | | | | | 25 | 50 | 75 |
| | | | | | | | 295.5 | 320.5 | 345.5 | 295.5 | 320.5 | 345.5 | 295.5 | 320.5 | 345.5 |
| % Rebound | | | | | | | 35 | 40 | 52 | 30 | 30 | 30 | 35 | 40 | 50 |
| Shore A Durometer | | | | | | | 95 | 70 | 50 | 90 | 80 | 65 | 85 | 70 | 65 |
| | | | | | | | 1.722 | 1.613 | 1.520 | 1.742 | 1.659 | 1.543 | 1.727 | 1.592 | 1.557 |

TABLE IV

| Center Weight Required (Grams) | Specific Gravity Required | Approx. Weight of Filler @ 4.4 Specific Grav. (Grams) | Center Weight Required (Grams) | Specific Gravity Required | Approx. Weight of Filler @ 4.4 Specific Grav. (Grams) |
|---|---|---|---|---|---|
| 15.0 | 1.594 | 110 | 18.6 | 1.977 | 201 |
| 15.2 | 1.615 | 114 | 18.8 | 1.998 | 209 |
| 15.4 | 1.637 | 118 | 19.0 | 2.019 | 214 |
| 15.6 | 1.658 | 124 | 19.2 | 2.040 | 220 |
| 15.8 | 1.679 | 130 | 19.4 | 2.062 | 226 |
| 16.0 | 1.700 | 135 | 19.6 | 2.083 | 233 |
| 16.2 | 1.722 | 140 | 19.8 | 2.104 | 240 |
| 16.4 | 1.743 | 144 | 20.0 | 2.125 | 247 |
| 16.6 | 1.764 | 148 | 20.2 | 2.147 | 253 |
| 16.8 | 1.735 | 152 | 20.4 | 2.168 | 260 |
| 17.0 | 1.807 | 158 | 20.6 | 2.189 | 268 |
| 17.2 | 1.828 | 162 | 20.8 | 2.210 | 274 |
| 17.4 | 1.849 | 167 | 21.0 | 2.232 | 280 |
| 17.6 | 1.870 | 174 | 21.2 | 2.255 | 288 |
| 17.8 | 1.892 | 180 | 21.4 | 2.274 | 296 |
| 18.0 | 1.913 | 185 | 21.6 | 2.295 | 303 |
| 18.2 | 1.934 | 190 | 21.8 | 2.310 | 310 |
| 18.4 | 1.955 | 195 | 22.0 | 2.338 | 320 |

What is claimed is:

1. A solid golf ball center having a substantially spherical form with high rebound capabilities comprising:

(a) a noncross-linked, butadiene-styrene radial block copolymer having a butadiene content in the range of about 50% to 85% by weight and a styrene content in the range of about 15% to 50% by weight; and (b) an inorganic filler material; said filler material composing the major portion by weight not exceeding 80% of said golf ball center, said center being substantially free of curing agents or initiators and said radial block copolymer having a molecular weight of at least 150,000 as measured by gel permeation chromotography.

2. The solid golf ball center as defined in claim 1 including an extender which is a paraffinic or napthenic oil.

3. The solid golf ball center as defined in claim 1 wherein said golf ball center has a weight in the range of about 15 grams to about 22 grams.

4. The solid golf ball center as defined in claim 1 wherein said filler material is present in the range of about 60% to about 80% by weight of the golf ball center.

5. The solid golf ball center as defined in claim 2 wherein said extender is present in an amount in the range of about 5% to 20% by weight of the golf ball center.

6. The solid golf ball center as defined in claim 1 wherein said butadiene is represented by 85% by weight of isoprene.

7. The solid golf ball center is defined in claim 4 wherein said filler material is barium sulfate.

8. The solid golf ball center as defined in claim 1 wherein the butadiene-styrene radial block copolymer has a molecular weight of about 160,000.

* * * * *